US006805243B1

(12) United States Patent
Kallioinen et al.

(10) Patent No.: US 6,805,243 B1
(45) Date of Patent: Oct. 19, 2004

(54) FLOTATION MACHINE ROTOR AND METHOD OF OPERATION

(75) Inventors: Jouko Kallioinen, Outokumpu (FI); Virendra Mody, Orillia (CA)

(73) Assignee: GL&V Dorr-Oliver Inc., Milford, CT (US)

( * ) Notice: Subject to any disclaimer, the term of this patent is extended or adjusted under 35 U.S.C. 154(b) by 29 days.

(21) Appl. No.: 10/246,966

(22) Filed: Sep. 19, 2002

Related U.S. Application Data

(60) Provisional application No. 60/324,031, filed on Sep. 21, 2001.

(51) Int. Cl.[7] ..... B03D 1/16; B01F 3/04
(52) U.S. Cl. ..... 209/164; 209/169; 261/87
(58) Field of Search ..... 209/164, 169; 261/87

(56) References Cited

U.S. PATENT DOCUMENTS 1,268,630 A * 6/1918 Ruth ..... 261/93
4,800,017 A * 1/1989 Krishnaswamy et al. ... 210/219

FOREIGN PATENT DOCUMENTS

SU 904788 * 5/1980
WO 97/06892 * 2/1997

* cited by examiner

*Primary Examiner*—Thomas M. Lithgow

(57) ABSTRACT

In a flotation machine rotor, a body portion defines an interior area that is adapted to communicate with a gas source. At least one rotor blade projects radially outwardly from the body portion with at least one aperture being defined thereby and in gaseous communication with the interior area. The aperture is positioned adjacent the rotor blade and is defined in part by a lower peripheral edge. At least one lip projects radially outwardly from the lower peripheral edge so that during operation of the rotor, solids traveling along the body portion are projected radially away from the rotor by the lip and become approximately aligned with the aperture so that gas flowing from the aperture creates bubbles in the slurry that entrain at least a portion of the solid particles. The bubbles and solid particles form a froth on the surface of the slurry which can then be removed from the flotation machine.

17 Claims, 3 Drawing Sheets

FLOTATION MACHINE ROTOR AND METHOD OF OPERATION

CROSS-REFERENCE TO RELATED APPLICATIONS

This application is entitled to the benefit of and incorporates by reference essential subject matter disclosed in Provisional Patent Application No. 60/324,031 filed on Sep. 21, 2001.

BACKGROUND OF THE INVENTION

Flotation machines are commonly employed to separate solid material from a slurry typically composed of liquids and solids in varying proportions. An impeller located in the flotation machine agitates the slurry dispersing entrapped gas, thereby causing the formation of gas bubbles. Particulate solid material adheres to the surface of the gas bubbles and rises therewith to the slurry surface forming a froth that has a higher concentration of adhered solid material, than does the slurry.

The froth, which is a combination of liquid, solid particles, and gas is removed from the flotation machine for further processing. The gas bubble/particle interaction is important to the flotation process as, without it, there can be no separation via the above-described method. To generate sufficient gas bubbles and thereby froth, gas is usually introduced through an opening in the impeller or rotor of the flotation machine. A prior art method of introducing the gas is shown in FIGS. 1, 2, and 3. Gas is introduced through apertures 12 in the rotor. These apertures tend to be large and located between successive pairs of rotor blades 14. The apertures 12 extend, in part through an upper surface 16 of the rotor 10, with the remainder of each aperture extending into a body portion 18 of the rotor.

During operation, particles tend to travel up the rotor body portion 18 following the contours thereof. The contours are generally smooth with no discontinuities or protuberances between successive rotor blades 14. As such, the peripheral edges of each aperture 12 follows the smooth contours of the rotor body portion 18.

A problem associated with rotors configured in the above-described manner is that there is a tendency for solid particles, to enter the rotor body portion 18, through the apertures 12. Another problem attributed to these prior art rotors is that the distribution of gas bubbles attributable to the air entering through an aperture is not optimal due to the apertures configuration. This in turn minimizes the gas bubble/particle interaction and thereby the solid/liquid separation.

Based on the foregoing it is the general object of the present invention to provide a flotation machine rotor that overcomes the problems and drawbacks of prior art rotors.

SUMMARY OF THE INVENTION

The present invention resides in one aspect to a flotation machine rotor that includes a body portion which defines an interior area and is adapted to communicate with a gas source. At least one rotor blade projects radially outwardly from the body portion with at least one aperture being defined by the body portion. The aperture is in gaseous communication with the interior area and is adjacent the at least one rotor blade. During operation, gas flowing from the gas source is expelled through the aperture causing bubbles to be generated in a liquid/solid slurry in which the flotation machine rotor is immersed. The aperture is defined at least in-part by a lower peripheral edge. At least one lip projects outwardly from the lower peripheral edge. As the rotor operates, solid particles forming part of the liquid solid slurry travel upwardly along the body portion and encounter the lip. The solid particles are then projected away from the body portion and into approximate alignment with the aperture. The gas bubbles generated by gas being expelled from the aperture entrain the solid particles thereby forming a froth of gas bubbles and entrapped particles on the slurry surface which is then skimmed off, clarifying the slurry.

Preferably, the aperture is in the form of a slot and extends in a longitudinal direction approximately perpendicular to a central axis defined by the rotor. In the preferred embodiment of the present invention there are a plurality of slots each having a lip projecting from a lower peripheral edge of each slot. In addition, the body portion can be contoured with a diameter defined thereby progressively increasing from a lower to an upper section of the body portion. The slots are positioned in the upper section of the body portion.

The present invention resides in another aspect in a method for operating a flotation machine rotor of the above-described type wherein a liquid/solid slurry is introduce into a flotation machine and the rotor is caused to spin about the central axis so that the solid partides forming part of the slurry move upwardly along the body portion and contact the lips associated with the apertures in the body portion. At least a portion of the solid particles are projected radially away from the rotor by the lip and become approximately aligned with the associated aperture. Gas from the gas source is caused to flow from the aperture thereby forming bubbles in the slurry that define a surface upon which a portion of the solid particles projected from the lip contact and are entrain thereon. These bubbles and entrained solids cause a froth to form on the surface of the liquid solid slurry which can then be removed from the flotation machine.

DETAILED DESCRIPTION OF THE PREFERRED EMBODIMENT

Figure 1:
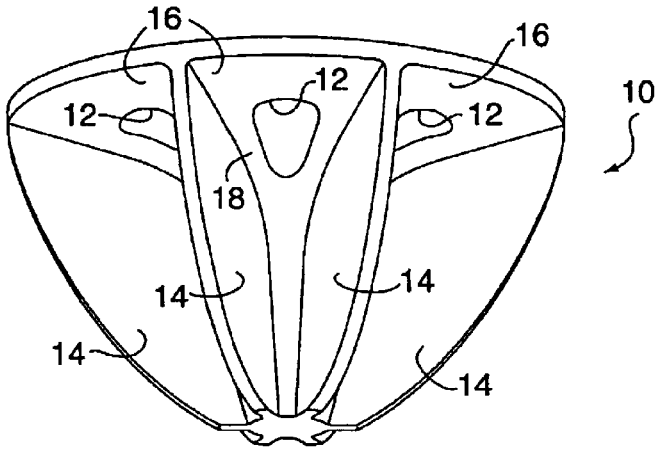
FIG. 1 PRIOR ART
FIG. 1 is a perspective view of a prior art flotation machine rotor.
Figure 2:
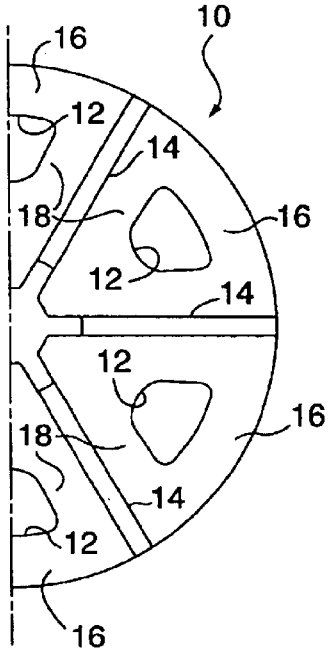
FIG. 2 PRIOR ART
FIG. 2 is a partial, bottom view of the rotor of FIG. 1.
Figure 3:
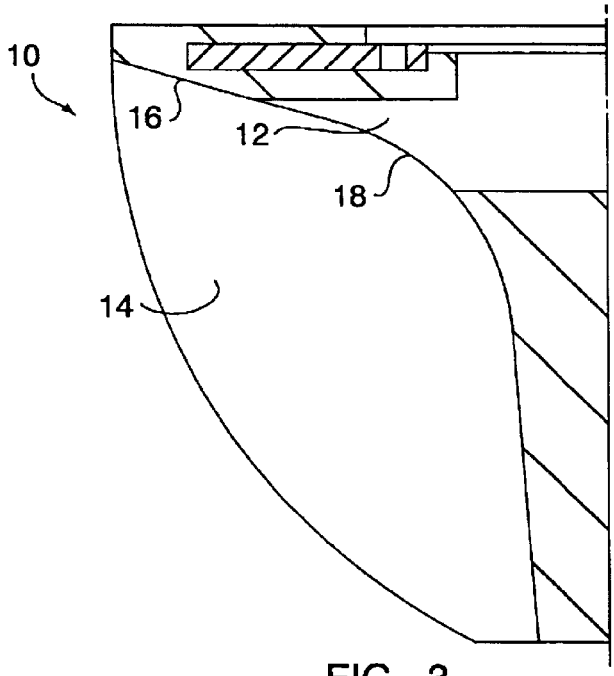
FIG. 3 PRIOR ART
FIG. 3 is a partial, cross-sectional view of the rotor of FIG. 1.
Figure 4:
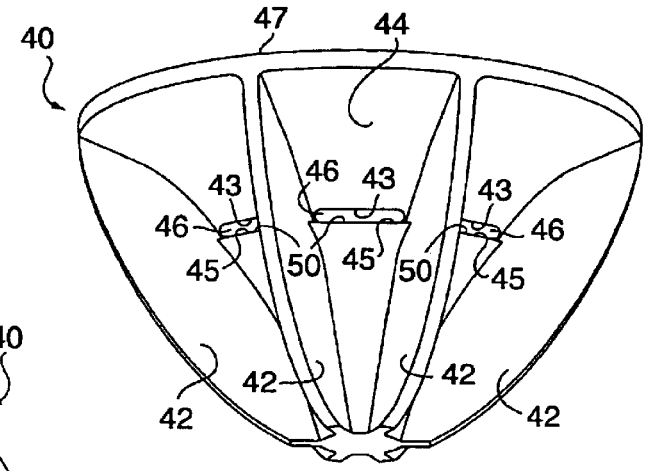
FIG. 4 is a perspective view of a flotation machine rotor embodying the present invention.
Figure 5:
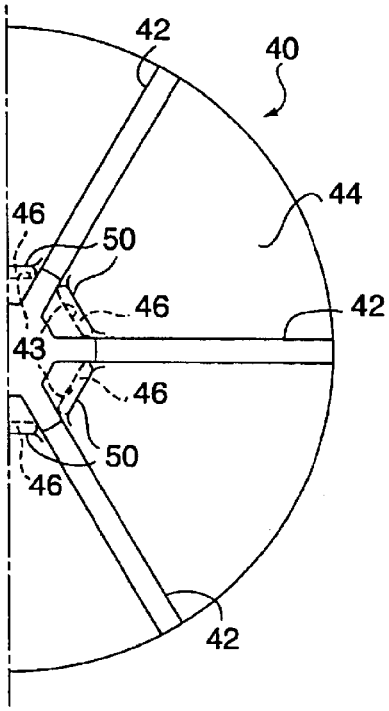
FIG. 5 is a bottom plan view of the rotor of FIG. 4.

As shown in FIGS. 4 and 5, a flotation machine rotor embodying the present invention and generally designated by the reference number 40 includes a plurality of rotor blades 42, each extending radially from a rotor body portion 44. The rotor body portion 44 defines a plurality of approximately horizontal slots 46 extending therethrough part-way between an upper and lower portion of the rotor 40. Each slot is defined in part by an upper and a lower peripheral edge, 43 and 45 respectively. The upper peripheral edge of each slot 46 being closer to an upper surface 47 of the rotor 40. As used herein, the terms upper, lower, horizontal, vertical, and the like are intended to apply only to the particular orientation of the rotor as shown in the figures. Since other rotor orientations are possible, these terms should be broadly construed, and not interpreted in a limiting sense.

Figure 6:
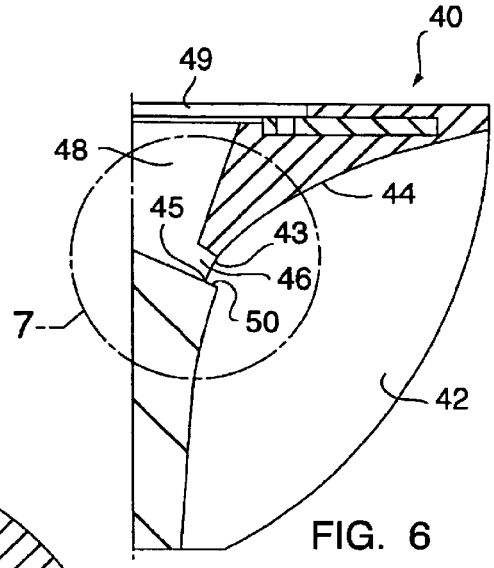
FIG. 6 is a partial, cross-sectional view of the rotor of FIG. 4.

As shown in FIG. 6, the slots 46 each open into an interior area 48 defined by the rotor 40, and as will be explained in detail below are used to supply gas, usually air, into the rotor and thereby into the slurry introduced therein. The rotor defines an opening 49 in gaseous communication with the interior area 48. The rotor body portion 44 includes a plurality of lips 50 each projecting radially outward from a lower peripheral edge 45 defined by each slot 46. The lips each cause a break in the otherwise smooth contour defined by the rotor body portion.

Figure 7:
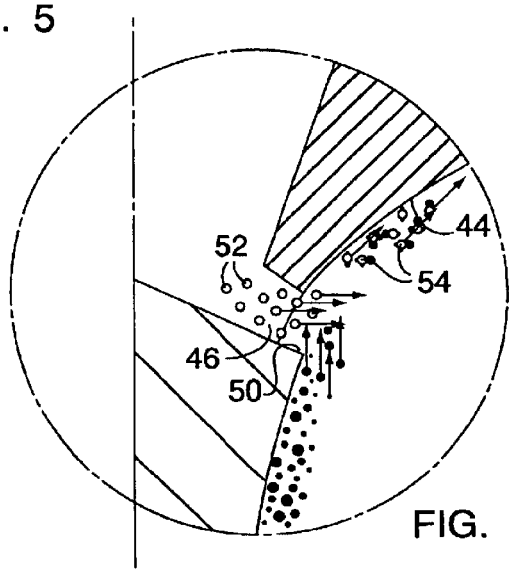
FIG. 7 is an enlarged view of a portion of the rotor of FIG. 7.

Turning to FIGS. 6 and 7, during operation the rotor 40 is positioned in a housing (not shown) and rotated at a predetermined speed by a suitable drive, such as, but not limited to a motor. A liquid/solid particle slurry is introduced into the housing and the rotation of the rotor 40 causes the solid particles entrained in the slurry to travel up the rotor body portion 44 over the lip 50 which acts to project the particles away for the rotor where gas flowing through each slot 46 causes the formation of air bubbles 52 that contact and entrain the solid particles. The rotor 40, in order to introduce gas bubbles into the slurry is coupled to a gas source that is in gaseous communication with the a perture 49 and thereby the interior area 48, see FIG. 6. The gas bubbles having the particles entrained thereon are shown in the illustrated embodiment as element 54. These gas bubbles having solid particles entrained thereon are carried to a point where they can be removed from the flotation machine. An advantage of the present invention is that the lips 50 will aid in the prevention of particles entering the interior of the rotor as well as in placing the particles in the gas stream flowing from the slots 46. In addition, the slots provide large gas bubble/particle contact areas. Furthermore, the combination of the slots and lips can cause a venturi-like effect pulling greater quantities of gas through the slots. While approximately horizontal slots have been shown and described, the present invention is not limited in this regard as other orientations such as, but not limited to vertical slots can be substituted without departing from the broader aspects of the present invention.

Figure 8:
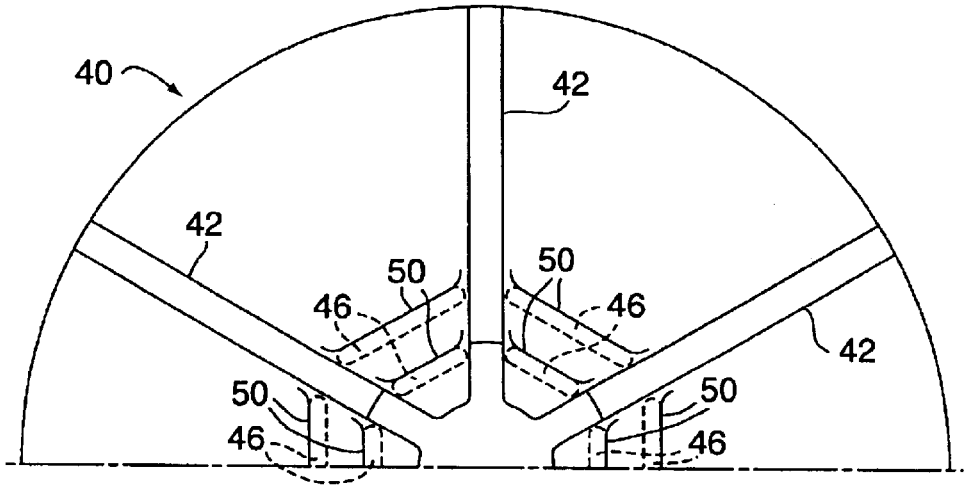
FIG. 8 is a partial bottom plan view of an alternate embodiment of the present invention.
Figure 9:
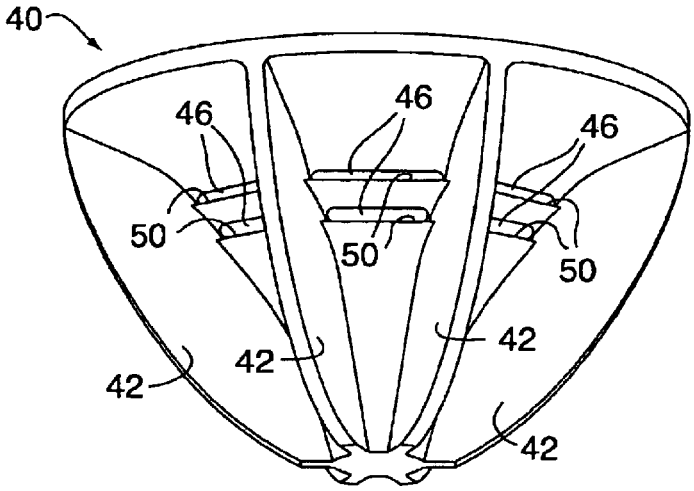
FIG. 9 is a perspective view of the embodiment of FIG. 8.

While a single circumferentially disposed row of slots 46 has been shown and described, the present invention is not limited in this regard. As shown in FIGS. 8 and 9, more than one circumferentially disposed row of slots 46 (two shown) each having a radially protruding lip 50 associated therewith, can be provided without departing from the broader aspects of the present invention. While preferred embodiments have been shown and described, various modifications and substitutions may be made without departing from the spirit and scope of the invention. Accordingly, it is to be understood that the present invention has been described by way of example, and not by limitation.

What is claimed is:

1. A flotation machine rotor comprising:

a body portion defining an interior area adapted to communicate with a gas source;

at least one rotor blade projecting radially outwardly from said body portion;

at least one aperture defined by said body portion and in gaseous communication with said interior area, said aperture being positioned adjacent to said at least one rotor blade and being defined in-part by a lower peripheral edge, said body portion having a first section on one side of said aperture and a second section on another side of said aperture, said first section being contoured with a diameter continuously increasing in a direction towards said aperture, said second section being contoured with a diameter continuously increasing in a direction away from said aperture; and at least one lip projecting radially outwardly from said lower peripheral edge so that, during operation of said rotor, solid particles forming part of a solid/liquid slurry travel away from said body portion and in approximate alignment with said aperture so that gas flowing from said aperture creates bubbles in said slurry that entrain at least a portion of said solid particles.

2. A flotation machine rotor as defined by claim 1, wherein said aperture is a slot that extends in a longitudinal direction approximately perpendicular to a central axis defined by said rotor.

3. A flotation machine rotor as defined by claim 2, wherein:

said at least one rotor blade includes a plurality of rotor blades;

said slot includes a plurality of slots, each positioned between a pair of said rotor blades each of said slots being defined in-part by an upper peripheral edge and a lower peripheral edge; and wherein said at least one lip includes a plurality of lips, each adjacent to and projecting outwardly from said lower peripheral edge of one of said slots.

4. A flotation machine rotor as defined by claim 1, wherein:

said body portion defines an opening in gaseous communication with said interior area.

5. A flotation machine rotor as defined by claim 4, wherein said opening is in communication with a gas source.

6. A flotation machine rotor as defined by claim 1, wherein said body portion is approximately symmetrical about a central axis.

7. A flotation machine rotor as defined by claim 1, wherein said aperture is positioned in an upper portion of said body.

8. A flotation machine rotor as defined by claim 1, wherein said first section is located below said aperture and said second section is located above said aperture, the diameter of said first section continuously increasing from a lower end to an upper end of said first section, the diameter of said second section continuously increasing from a lower end to an upper end of said second section.

9. A method for operating a flotation machine rotor, comprising:

providing a rotor forming part of a flotation machine, said rotor including a body portion defining an interior area adapted to communicate with a gas source, a plurality of rotor blades projecting radially outwardly from said body portion, at least one aperture defined by said body portion and in gaseous communication with said interior area, said aperture being positioned between successive rotor blades, said at least one aperture being defined in-part by a lower peripheral edge, and at least one lip projecting radially outwardly from said lower peripheral edge;

introducing a liquid/solid slurry into said flotation machine;

causing said rotor to spin about a central axis so that solid particles forming part of said slurry move upwardly along said body portion and contact said lip projecting at least a portion of said solid particles radially away from said rotor and in approximate alignment with said aperture;

causing gas to flow from said aperture, thereby forming bubbles defining a surface upon which a portion of said solid particles, that have passed over said lip, contact and are entrained thereon;

inducing a venturi-like effect to pull greater quantities of gas through said aperture by virtue of a relative configuration of said aperture and said lip;

forming a froth comprising said bubbles having said solid particles entrained thereon; and removing said froth from said flotation machine.

10. A flotation machine rotor comprising:

a body portion defining an interior area adapted to communicate with a gas source;

at least one rotor blade projecting radially outwardly from said body portion;

at least one aperture defined by said body portion and in gaseous communication with said interior area, said aperture being positioned adjacent to said at least one rotor blade and being defined in-part by a lower peripheral edge;

at least one lip projecting radially outwardly from said lower peripheral edge so that, during operation of said rotor, solid particles forming part of a solid/liquid slurry travel away from said body portion and in approximate alignment with said aperture so that gas flowing from said aperture creates bubbles in said slurry that entrain at least a portion of said solid particles, said lip and said aperture being so dimensioned as to create a venturi-like effect pulling greater quantities of gas through said aperture.

11. A flotation machine rotor as defined by claim 10, wherein said aperture is a slot that extends in a longitudinal direction approximately perpendicular to a central axis defined by said rotor.

12. A flotation machine rotor as defined by claim 11, wherein:

said at least one rotor blade includes a plurality of rotor blades;

said slot includes a plurality of slots, each positioned between a pair of said rotor blades each of said slots being defined in-part by an upper peripheral edge and a lower peripheral edge; and wherein said at least one lip includes a plurality of lips, each adjacent to and projecting outwardly from said lower peripheral edge of one of said slots.

13. A flotation machine rotor as defined by claim 10, wherein:

said body portion defines an opening in gaseous communication with said interior area.

14. A flotation machine rotor as defined by claim 13, wherein said opening is in communication with a gas source.

15. A flotation machine rotor as defined by claim 10, wherein said body portion is contoured.

16. A flotation machine rotor as defined by claim 15, wherein said body portion is approximately symmetrical about a central axis and progressively increases in diameter from a lower to an upper portion.

17. A flotation machine rotor as defined by claim 10, wherein said aperture is positioned in an upper portion of said body.

* * * * *